US010231904B1

(12) United States Patent
Cowley et al.

(10) Patent No.: US 10,231,904 B1
(45) Date of Patent: Mar. 19, 2019

(54) COOLER FOR MAINTAINING VACCINES AT CORRECT TEMPERATURES WHILE SIMULTANEOUSLY PROVIDING VACCINE GUN HOLSTERS

(71) Applicants: Michael Allen Cowley, Henrietta, TX (US); Mike Anthony Fairchild, Jr., Henrietta, TX (US)

(72) Inventors: Michael Allen Cowley, Henrietta, TX (US); Mike Anthony Fairchild, Jr., Henrietta, TX (US)

(73) Assignee: PIERCE ARROW, INC., Henrietta, TX (US)

( * ) Notice: Subject to any disclaimer, the term of this patent is extended or adjusted under 35 U.S.C. 154(b) by 87 days.

(21) Appl. No.: 15/424,112

(22) Filed: Feb. 3, 2017

Related U.S. Application Data

(60) Provisional application No. 62/412,095, filed on Oct. 24, 2016.

(51) Int. Cl.

| | |
|---|---|
| ***F25D 3/08*** | (2006.01) |
| ***A61J 1/16*** | (2006.01) |
| ***F25D 3/06*** | (2006.01) |
| ***F25D 23/12*** | (2006.01) |
| ***F25D 29/00*** | (2006.01) |
| ***F25D 23/02*** | (2006.01) |
| ***B65D 25/20*** | (2006.01) |
| ***B65D 43/16*** | (2006.01) |
| ***B65D 43/26*** | (2006.01) |
| ***B65D 81/38*** | (2006.01) |

(52) U.S. Cl.
CPC ..... *A61J 1/165* (2013.01); *B65D 25/20* (2013.01); *B65D 43/16* (2013.01); *B65D 43/26* (2013.01); *B65D 81/3813* (2013.01); *F25D 3/06* (2013.01); *F25D 23/025* (2013.01); *F25D 23/12* (2013.01); *F25D 29/008* (2013.01); *F25D 2303/081* (2013.01); *F25D 2303/0843* (2013.01); *F25D 2303/0845* (2013.01); *F25D 2331/812* (2013.01)

(58) Field of Classification Search
CPC ..... F25D 3/08; F25D 2331/809; F25D 2331/8014; A61J 1/165; A61M 5/003
USPC ..... 206/570, 571; 220/592.01
See application file for complete search history.

(56) References Cited

U.S. PATENT DOCUMENTS 4,250,998 A * 2/1981 Taylor ..... A45C 11/20 206/570
4,704,875 A * 11/1987 Kieler ..... F25D 3/08 220/555
8,505,726 B1 * 8/2013 Woog ..... F25D 31/007 206/457

(Continued)

*Primary Examiner* — Shawn M Braden
(74) *Attorney, Agent, or Firm* — Plager Schack LLP; Mark H. Plager; Kara Verryt

(57) ABSTRACT

A cooler for maintaining an internal temperature while simultaneously protecting contents stored therein from UV light may include a container body with an interior region, the interior region sized to accommodate items to be kept within a desired temperature range; a lid hingeably attached to the container body; an angled lip extending from an outer edge of the container body; and at least one holster built into the angled lip, wherein the at least one holster is sized to accommodate a vaccine gun. The cooler may also include an alerting temperature gauge configured to alert a user when the temperature in the interior region falls outside of the desired temperature range.

8 Claims, 4 Drawing Sheets

(56) References Cited

U.S. PATENT DOCUMENTS

| | | | | |
|---|---|---|---|---|
| 2010/0282762 | A1* | 11/2010 | Leonard | A61J 1/165<br>220/592.01 |
| 2014/0169926 | A1* | 6/2014 | Henderson | B65D 81/3834<br>414/800 |
| 2015/0375918 | A1* | 12/2015 | Holderness | B67D 3/0067<br>222/566 |

* cited by examiner

COOLER FOR MAINTAINING VACCINES AT CORRECT TEMPERATURES WHILE SIMULTANEOUSLY PROVIDING VACCINE GUN HOLSTERS

RELATED APPLICATION

This application claims priority to provisional patent application U.S. Ser. No. 62/412,095 filed on Oct. 24, 2016, the entire contents of which is herein incorporated by reference.

BACKGROUND

The embodiments herein relate generally to medical devices, and more particularly, to a cooler that holds vaccines at the correct temperature while simultaneously providing holsters to store the vaccine guns.

Vaccines need to be kept at the correct temperature and out of UV light to avoid damaging the vaccine. When it comes to vaccinating animals, vaccine guns often need to be loaded and ready to be used quickly, especially if the animal is scared. It is currently almost impossible to keep vaccine guns and vaccine reloads covered and at the correct temperature while also having them ready for quick use with the existing coolers.

Therefore, what is needed is a cooler that can maintain vaccines at the correct temperature, store vaccine guns, and allow the vaccines and guns to be readily available.

SUMMARY

Some embodiments of the present disclosure include a cooler for maintaining an internal temperature while simultaneously protecting contents stored therein from UV light may include a container body with an interior region, the interior region sized to accommodate items to be kept within a desired temperature range; a lid hingeably attached to the container body; an angled lip extending from an outer edge of the container body; and at least one holster built into the angled lip, wherein the at least one holster is sized to accommodate a vaccine gun. The cooler may also include an alerting temperature gauge configured to alert a user when the temperature in the interior region falls outside of the desired temperature range.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
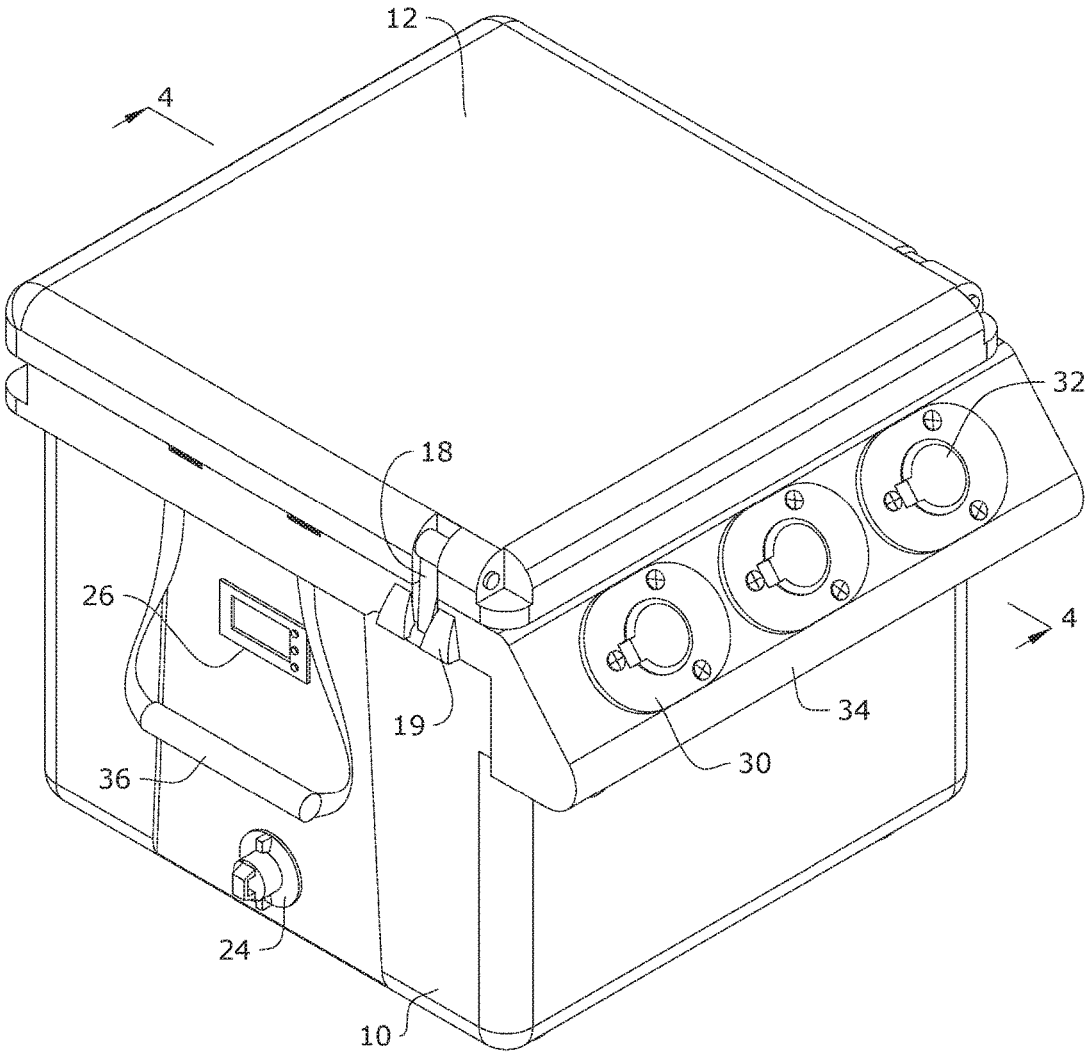
FIG. 1 is a perspective view of one embodiment of the present disclosure.
Figure 2:
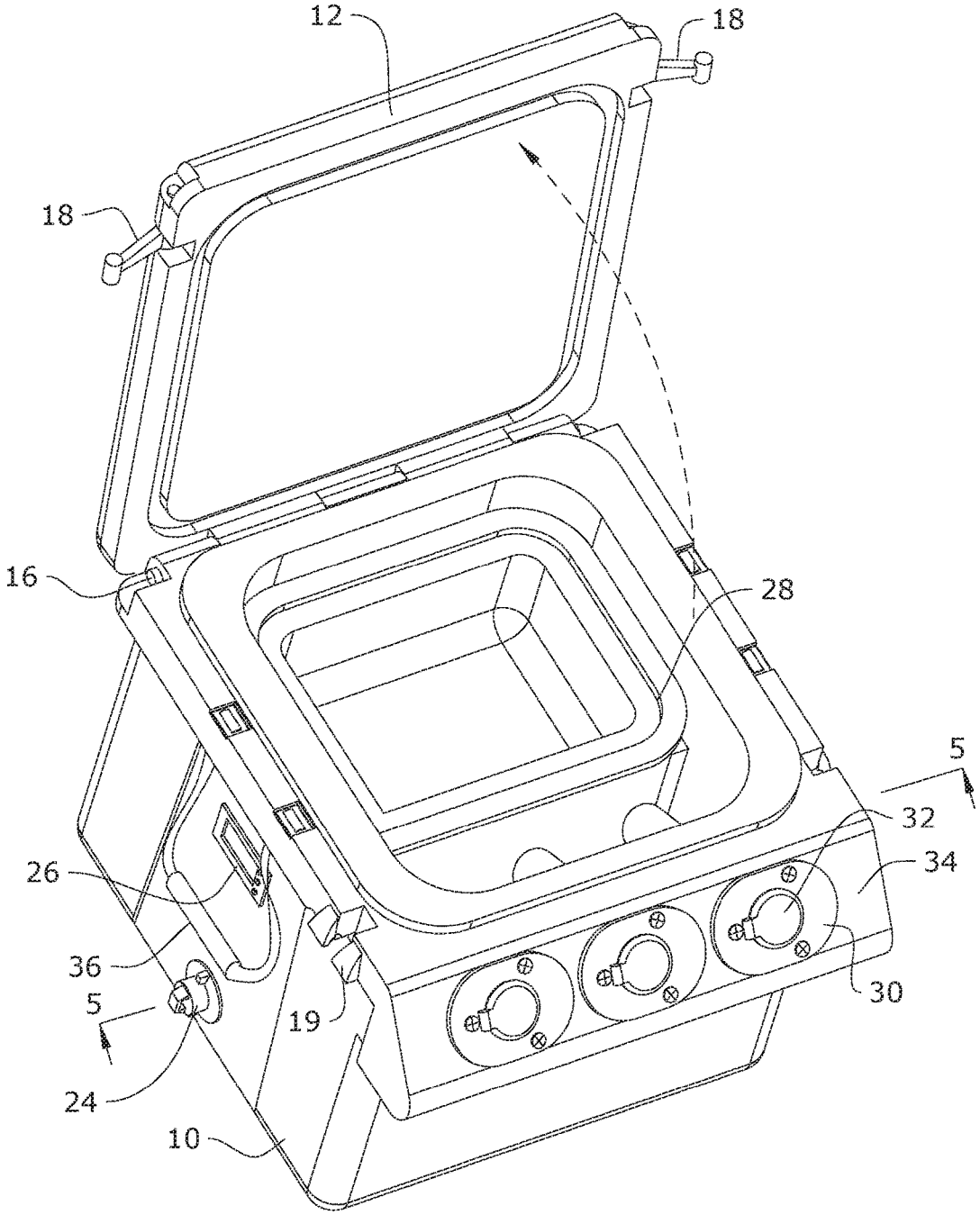
FIG. 2 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to hold vaccines at a constant temperature, store vaccine guns, and prevent the vaccines from UV light and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Container Body
2. Lid
3. Temperature Gauge
4. Holster
5. Dry Storage Tray

The various elements of the device of the present disclosure may be related in the following exemplary fashion. It is not intended to limit the scope or nature of the relationships between the various elements and the following examples are presented as illustrative examples only.

By way of example, and referring to FIGS. 1-5, some embodiments of the present disclosure include a cooler for maintaining an internal temperature while simultaneously protecting the contents from UV light, the cooler comprising a container body 10 with an interior region 9, the interior region 9 sized to accommodate items 40 to be kept within a desired temperature range; a lid 12 hingeably attached to the container body 10; an angled lip 34 extending from at least one outer edge of the container body 10; and at least one holster 30 built into the angled lip 34, wherein the at least one holster 30 is sized to accommodate a vaccine gun 42.

Figure 5:
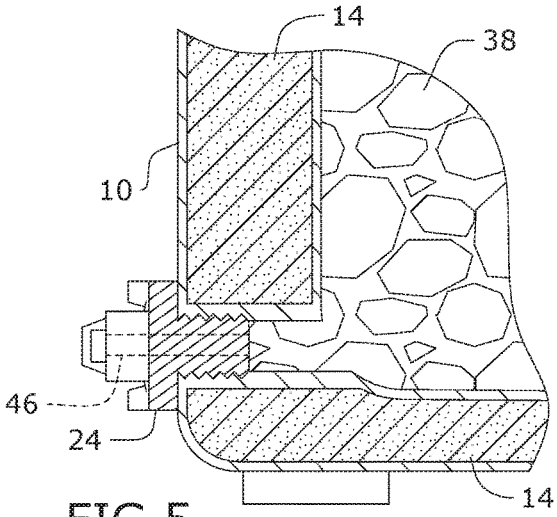
FIG. 5 is a section detail view of one embodiment of the present disclosure, taken along line 5-5 in FIG. 2.

As shown in the Figures, the interior region 9 may be spaced from an outer edge of the container body 10, and insulation 14 may be positioned between the interior region 9 and the container body 10, such that the interior region 9 is surrounded by insulation 14. As shown in FIG. 5, a drain orifice may extend from the interior region 9 through the insulation 14 and through the container body 10, such that the interior region 9 may be drained, when necessary, without opening the lid 12. A drain plug 24 may removably engage with the drain orifice, such that the drain plug 24 prevents the interior region 9 from inadvertently draining and prevents a temperature change within the interior region 9 when the drain plug 9 is engaged with the drain orifice. In some embodiments, such as that shown in FIG. 5, the drain plug 9 may comprise a smaller drain 46 built therein, such that the interior region 9 may be drained without removing the entire drain plug 9, which may help prevent a temperature change within the interior region 9 during draining.

Figure 3:
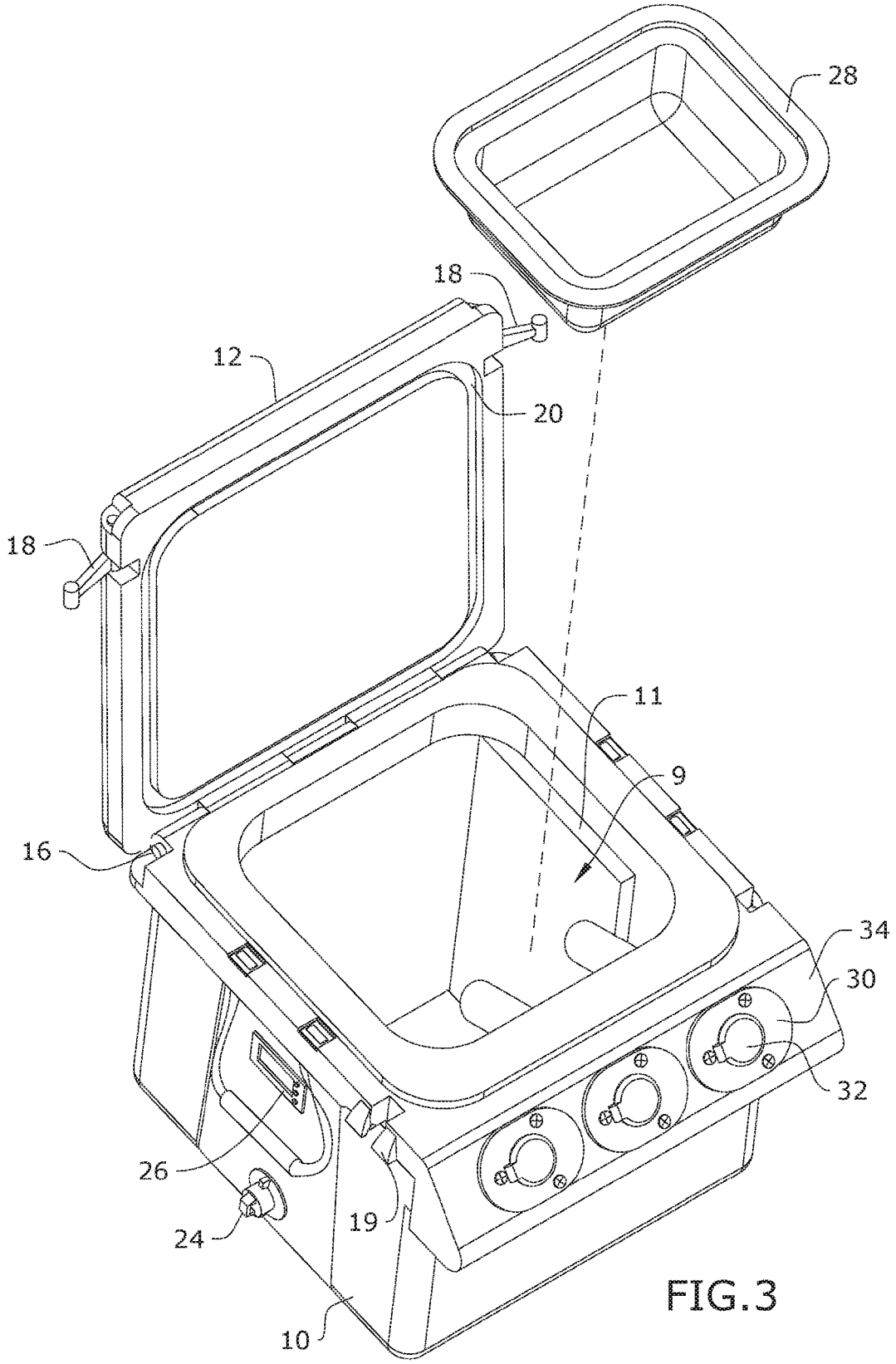
FIG. 3 is an exploded view of one embodiment of the present disclosure.
Figure 4:
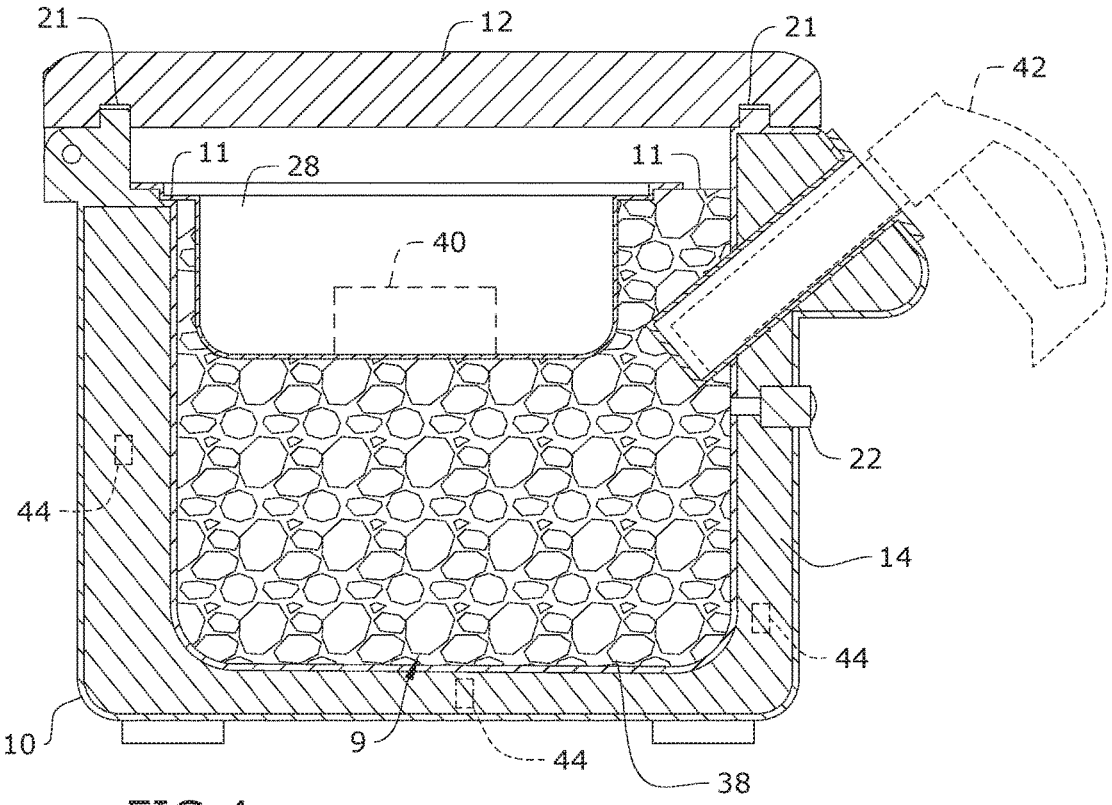
FIG. 4 is a section view of one embodiment of the present disclosure, taken along line 4-4 in FIG. 1.

As also shown in the Figures, the interior region 9 may include an upper ledge 11, wherein the upper ledge 11 is designed to support a dry storage tray 28. As shown in FIG. 3, the dry storage tray 28 may be removable to access the area of the interior region 9 vertically below the dry storage tray 28. When the dry storage tray 28 is placed on the upper ledge 11, a bottom surface of the dry storage tray 28 may be spaced from a bottom surface of the interior region 9, such that ice 38 or other cooling or heating materials may be placed within the interior region 9 between the bottom surface of the dry storage tray 28 and the bottom surface of the interior region 9. The items 40 to be cooled (or heated) may be placed in the dry storage tray 28, as shown in FIG.

4, such that the bottom surface of the dry storage tray 28 acts as a barrier between the items 40 and the ice 38 or other cooling or heating materials.

As explained above, the lid 12 may be hingeably attached to the container body 10 by, for example, a lid hinge 16. The lid 12 may also lock or otherwise secure to the container body 10. For example, as shown in the Figures, the lid 12 may comprise a plurality of latches 18, such as T-rex latches, hingeably extending from an outer edge thereof. The container body 10 may comprise a matching number of latch extensions 19 extending from an upper edge thereof, wherein the latch extensions 19 are positioned to align with the latches 18 when the lid 12 is closed and wherein the latches 18 engage with the latch extensions 19 to prevent the lid 12 from inadvertently opening and to lock the lid 12 tightly to the container body, casing the lid 12 to press firmly on the top of the container body 10, creating a tight seal. In some embodiments, an interior surface of the lid 12 comprises a groove 20 configured to engage with a ridge 21 extending from the container body 10 to create a seal, such as a freezer grade seal, when the lid 12 is closed.

The angled lip 34 may include at least one holster 30, such as a plurality of holsters 30, such as three holsters 30. The holster 30 may be sized to accommodate a vaccine gun 42 and may extend from an opening in the surface of the lip down into the container body 10 proximate to the interior region 9, but not into the interior region 9. The holster 30 may comprise a substantially cylindrical channel extending into the insulation 14. The channel may extend downward at an angle. In a particular embodiment, the holster channel may extend downward at an angle of about 45°. However, other angles are also envisioned. In fact, so long as the lid 12 can still be opened when a vaccine gun 42 is in the holster 30, and the holster 30 does not extend into the interior region, any angle may be used. Embodiments of the cooler may further comprise holster caps 32 configured to close over each holster 30 when the holster 30 is not in use.

As shown in the Figures, the cooler may further comprise an alerting temperature gauge 26, such as a digital alerting temperature gauge, positioned within the container body 10 and operatively attached to a plurality of sensors 44 positioned throughout the container body 10, wherein the sensors 44 are configured to continuously monitor the temperature of the interior region 9 of the container body 10. A user may set a predetermined temperature or range of temperatures and, when the interior region 9 deviates from the predetermined range of temperatures, the temperature gauge 26 may alert the user. The alert may be audible, visual, or any other conventional alert.

The cooler may further comprise a pressure relief valve 22 built into the container body 10. The pressure relief valve 22 may create a small opening into the interior of the container body 10, relieving the pressure inside the cooler until it reaches a pressure similar to the surrounding atmosphere, making it easier to open the lid 12 when it has been sealed shut.

The cooler may also comprise handles 36 attached to an exterior surface of the container body 10, wherein the handles 36 enable a user to easily transport the cooler. In some embodiments, the cooler may also include wheels (not shown) and a pull handle, such that a user can easily roll the cooler along a ground surface. Moreover, the cooler may include a plurality of feet on which the cooler may stand.

The cooler of the present disclosure may be made of any suitable or desired materials. In some embodiments, the cooler, including the lid 12 and the container body 10, may be molded through a rotational (roto) molding process. Suitable materials for manufacturing the lid 12 and container body 10 include materials configured to block UV light, such that the interior region 9 and the holsters 30 are protected from UV light. During the roto molding process, a polyethylene base, for example, with a pigment is heated in a mold until shaped to the mold using a roto mold machine. The mold may be slowly cooled and the shell of the lid 12 and the container body 10 are removed from the mold. Once removed from the mold, the shells may be injected with foam insulation 14 through, for example, small ports on the rear of the lid 12 and through feet mounting holes on the container body 10. Once the shell and its inner foam insulation 14 cool and settle completely, the container body 10 and the lid 12 may be assembled together via a lid hinge 16, such as a stainless steel hinge rod. Latches 18, such as rubber T-rex latches, may be installed on the lid 12, wherein the latches 18 can swivel and engage with the latch extensions 19.

The holsters 30 and the dry storage tray 28 may be made of, for example, stainless steel. Other features of the cooler may be made using any suitable or desired materials.

To use the cooler of the present disclosure, a user would place the desired amount of ice, ice packs, cooling material, or heating material into the interior region 9. Once the interior region 9 reaches the desired temperature, as indicated on the temperature gauge 26, items 40 to be stored may be placed on the storage tray 28, which may then be placed on the ledges 11 in the interior region 9. Once the storage tray 28 is loaded, the lid 12 may be closed and secured shut using the latches 18.

The cooler may be used to transport vaccinations for animals. In such cases, the temperature range may be set at those suitable for the vaccine being transported. When the user arrives at the chute or animal's location, the user may place the cooler in a safe place close to the animals to be vaccinated. Vaccine guns 42 may be loaded and placed into the holsters 30, positioning the guns 42 for quick and easy access, while also keeping them out of UV light and at a desired temperature.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cooler for maintaining an internal temperature while simultaneously protecting contents stored therein from UV light, the cooler comprising:

a container body with an interior region, the interior region sized to accommodate items to be kept within a desired temperature range;

a lid hingeably attached to the container body;

an angled lip extending from an outer edge of the container body;

at least one holster built into the angled lip;

an alerting temperature gauge positioned within the container body; and a plurality of sensors operatively attached to the alerting temperature gauge and positioned throughout the container body, the plurality of sensors being configured to continuously monitor the temperature of the interior region of the container body, wherein the at least one holster is sized to accommodate a vaccine gun.

2. The cooler of claim 1, further comprising insulation positioned between the interior region and an exterior of the container body.

3. The cooler of claim 2, wherein the at least one holster comprises a channel extending at a downward angle into the insulation.

4. The cooler of claim 3, wherein the channel extends downward at an angle of about 45°.

5. The cooler of claim 1, wherein:

the interior region includes an upper ledge;

the upper ledge is designed to support a dry storage tray; and when the dry storage tray is placed on the upper ledge, a bottom surface of the dry storage tray is spaced from a bottom surface of the interior region.

6. The cooler of claim 1, wherein:

the lid comprises a plurality of latches extending from an outer edge thereof;

the container body comprises a plurality of latch extensions extending from an upper edge thereof, the latch extensions being positioned to align with the latches when the lid is closed; and the latches engage with the latch extensions when the lid is closed, locking the lid to the container body.

7. The cooler of claim 1, wherein when the temperature goes outside of the desired temperature range, the alerting temperature gauge sets off an alert.

8. The cooler of claim 1, wherein the container body and the lid comprise UV impermeable material.

* * * * *